US005450793A

United States Patent [19]

Dobson et al.

[11] Patent Number: 5,450,793

[45] Date of Patent: Sep. 19, 1995

[54] PRINTING OR MARKING APPARATUS WITH EXCHANGEABLE HEATING STRUCTURE

[75] Inventors: Thomas W. Dobson; Bruce Lepisto; Edward E. Freyenhagen, all of Keene, N.H.

[73] Assignee: Markem Corporation, Keene, N.H.

[21] Appl. No.: 56,855

[22] Filed: May 4, 1993

[51] Int. Cl.[6] ..... B41F 23/04

[52] U.S. Cl. ..... 101/487; 101/328; 219/469; 219/470

[58] Field of Search ..... 101/328, 329, 8, 10–11, 101/25, 32, 487, 488, 9, 27, 31, 348; 219/216, 469, 470, 471, 552; 346/76 PH

[56] References Cited

U.S. PATENT DOCUMENTS

| | | | |
|---|---|---|---|
| 796,212 | 8/1905 | Horsell | 101/348 |
| 2,558,354 | 6/1951 | Gottscho | 101/8 |
| 3,097,592 | 7/1963 | Friedman | 101/8 |
| 3,217,637 | 11/1965 | Worth . | |
| 3,230,106 | 1/1966 | West | 101/487 |
| 3,423,573 | 1/1969 | Richards et al. | 219/469 |
| 3,548,928 | 12/1970 | Kesten | 219/469 |
| 3,629,555 | 12/1971 | Herbert, Jr. | 219/216 |
| 4,009,953 | 3/1977 | Ravizza et al. | 219/216 |
| 4,023,482 | 5/1977 | Swett et al. . | |
| 4,075,455 | 2/1978 | Kitamura et al. | 219/216 |
| 4,183,298 | 1/1980 | Cappel et al. | 101/348 |
| 4,527,472 | 7/1985 | Davison . | |
| 4,559,872 | 12/1985 | Perra, Jr. | 101/329 |
| 4,560,860 | 12/1985 | Fauser | 219/470 |
| 4,627,342 | 12/1986 | Yui . | |
| 4,627,349 | 12/1986 | Claussen | 101/348 |
| 4,933,724 | 6/1990 | Sugimoto et al. . | |
| 5,070,371 | 12/1991 | Bacus et al. | 219/216 |
| 5,074,213 | 12/1991 | Kurosawa | 101/487 |
| 5,105,065 | 4/1992 | Shibata | 101/9 |
| 5,189,960 | 3/1993 | Valentin et al. | 101/487 |
| 5,218,905 | 6/1993 | Bolte et al. | 101/348 |
| 5,223,901 | 6/1993 | Endo | 219/216 |
| 5,241,159 | 8/1993 | Chatteriee et al. | 219/216 |

FOREIGN PATENT DOCUMENTS

| | | | |
|---|---|---|---|
| 0119801 | 9/1984 | European Pat. Off. | 101/487 |
| 2255482 | 11/1972 | Germany . | |
| 4-14452 | 5/1990 | Japan | 101/487 |
| 2002975 | 10/1988 | Spain . | |
| 2245527 | 1/1992 | United Kingdom . | |

OTHER PUBLICATIONS

Model 904A Machine Manual, Markem Corporation, pp. 1, 3–2, 3–3, and 306 (Feb. 1985).

Model 905 Machine Manual, Markem Corporation, pp. 1, 70, 71 and 74 (Nov. 1991).

Model 984 Machine Manual, Markem Corporation, pp. 1, 2–4, 3–4 and "Main Frame" drawing 0825977 (Aug. 1986).

Dato 4 Flow S2 Product Sheet, Dato/Pack Europa, S.A. (not dated).

Patent Abstracts of Japan vol. 13, No. 217 Dated May 22, 1989.

*Primary Examiner*—Eugene H. Eickholt

*Attorney, Agent, or Firm*—Roylance, Abrams, Berdo & Goodman

[57] ABSTRACT

A printing or marking apparatus comprises a movable marking member having at least one marking device thereon, and a stationary heating structure having at least one heating element for maintaining the marking device at an elevated temperature. At least a portion of the stationary heating structure can be exchanged, removed or modified in order to vary the amount of heat applied to the marking device. In a preferred embodiment, the removable portion comprises a tubular heat pipe which extends into a hollow marking roll, and the heat pipe may be provided in different sizes or in segments which can be added or removed as desired. The disclosed apparatus is of particular utility in connection with ink compositions of the type which are solid at normal room temperatures, and which are rendered liquid or flowable at elevated temperatures.

47 Claims, 9 Drawing Sheets

PRINTING OR MARKING APPARATUS WITH EXCHANGEABLE HEATING STRUCTURE

BACKGROUND OF THE INVENTION

The present invention relates to printing or marking apparatus, and is particularly concerned with heated printing or marking apparatus in which at least a portion of the heating structure can be exchanged, removed or modified in order to control the temperature of the printing or marking element.

Product marking or coding operations are often carried out using thermoplastic ink compositions of the type which are solid at normal room temperatures, and which are rendered liquid or flowable at elevated temperatures. The ink composition must be kept heated while printing, but quickly cools and solidifies after it is applied so that the printed surface can be handled immediately without smearing the printed image. The ink supply is normally provided in the form of a porous ink roll that is impregnated with a thermoplastic ink composition of the type described, and these rolls are convenient to handle and store when the ink is in the solid state. Common types of product marking operations in which ink compositions of this type are used include date coding, lot or batch numbering, and the like. In general, the object is to print some type of variable information on products or product wrappers, using a very simple type of marking or coding apparatus which can be installed on an existing conveyor system.

U.S. Pat. No. 4,559,872, issued to Andrew G. Perra, Jr. on Dec. 24, 1985 and assigned to the assignee of the present invention, discloses a printing apparatus which utilizes a hot-melt ink composition for product marking or coding operations. The disclosed apparatus comprises a porous inking roll of the type described previously, an adjacent printing roll carrying one or more printing elements to which the ink is applied, and a stationary heater block containing a number of electrical heating elements for heating the inking roll and printing elements. The heater block is generally in the form of an inverted "U", with its closed end surrounding the inking roll and its open end partially surrounding the printing member. By heating both the inking roll and printing elements from the stationary heater block, a very simple and reliable printing apparatus is obtained. Prior arrangements employed ring and brush assemblies to conduct electrical current to heating elements within the rotating printing roll or type holder, and this led to undesirable complexity and component failure.

Although the apparatus described in U.S. Pat. No. 4,559,872 has proved useful in product marking and coding applications, there are situations in which it is desirable to modify the relative temperatures of the inking roll and printing elements. For example, certain types of packaging films with low softening points may require that the printing elements be maintained at a lower temperature than the inking roll, in order to prevent melting or deformation of the film. Conversely, in applications where heat-sensitive films are not being printed, it may be desirable to maintain the inking roll and printing elements at similar temperatures.

Various measures have been employed in the design of the printing apparatus to vary the relative temperatures of the inking roll and printing elements. One approach that has been employed with some success is to modify the basic heater block design to add a cylindrical extension, referred to as a heat pipe, which extends into the interior of the hollow printing roll to provide supplemental heating to the printing elements. The problem with this expedient, however, is that it is of a permanent nature and does not allow the end user to exercise any significant degree of control over the inking roll and printing element temperatures after the printing apparatus has been put into use.

SUMMARY OF THE INVENTION

In accordance with the present invention, the difficulties and limitations of the prior art are avoided by providing a heated printing or marking apparatus in which at least a portion of the heater block or other stationary heating structure can be exchanged, removed or modified by the user to control the temperature of the printing or marking elements. In a preferred embodiment of the invention, a removable portion is provided in the form of a tubular heat pipe which extends into the hollow printing roll, although other portions of the heating structure may be made removable if desired. The user may operate the printing apparatus with the heat pipe completely removed, in order to achieve the lowest possible temperature at the printing elements, or may replace the heat pipe with another heat pipe of different size to obtain a higher or lower temperature. The heat pipe may also be provided in segments, allowing the user to add or remove segments as desired in order to obtain the desired printing element temperature. In this way, control is obtained over the printing element temperatures without significantly affecting the overall design of the printing apparatus or increasing its complexity, and without affecting the operating temperature of the inking roll.

In one aspect, therefore, the present invention relates to a marking apparatus comprising a movable marking member having at least one marking device thereon, and a stationary heating structure having at least one heating element for maintaining the marking device at an elevated temperature. The stationary heating structure includes at least a first portion which is removable from the marking apparatus and is exchangeable with a replacement portion having a different physical characteristic affecting heating, in order to vary the amount of heat applied to the marking device. The physical characteristic may comprise an external dimension of the removable portion, or some other characteristic such as mass, thermal conductivity or the like.

In another aspect, the present invention relates to a rotary marking apparatus which comprises a movable marking member having at least one marking device thereon, and a stationary heating structure having at least one heating element for maintaining the marking device at an elevated temperature. The apparatus further comprises at least first and second heating structures which are attachable to and removable from the stationary heating structure in order to vary the amount of heat applied to the marking device. The supplemental heating structures may comprise cylindrical members which are received inside a hollow cylindrical printing roll, and which are attachable to each other in a coaxial end-to-end relationship.

In another aspect, the present invention relates to a rotary marking apparatus which comprises a hollow cylindrical marking roll having at least one marking device thereon, and a stationary heating structure having at least one heating element for maintaining the marking device at an elevated temperature. The stationary heating structure includes a cylindrical member which is received inside the marking roll and which is removable in whole or in part from the marking apparatus in order to vary the amount of heat applied to the marking device. The marking roll is removable from the marking apparatus to expose the cylindrical member, and the cylindrical member or portion thereof is removable from the marking apparatus by means accessible to the user upon removal of the marking roll.

The present invention is also directed to methods for controlling the temperature of a marking device carried by a movable marking member and heated by a stationary heating structure having at least one heating element. One such method comprises the step of removing at least a portion of the stationary heating structure in order to reduce the amount of heat applied to the marking device. Another such method comprises the further step of replacing the removed portion with a replacement portion having a different physical characteristic affecting heating, such that the amount of heat applied to the marking device is varied.

The present invention is of particular utility in connection with heated printing apparatus employing hot-melt thermoplastic ink compositions, but is also applicable to other types of heated printing, stamping or embossing devices.

BRIEF DESCRIPTION OF THE DRAWINGS

The various objects, advantages and novel features of the invention will be more readily apprehended from the following detailed description when read in conjunction with the appended drawings, in which.

Throughout the drawings, like reference numerals will be understood to refer to like parts.

DETAILED DESCRIPTION OF THE PREFERRED EMBODIMENT

Figure 1:
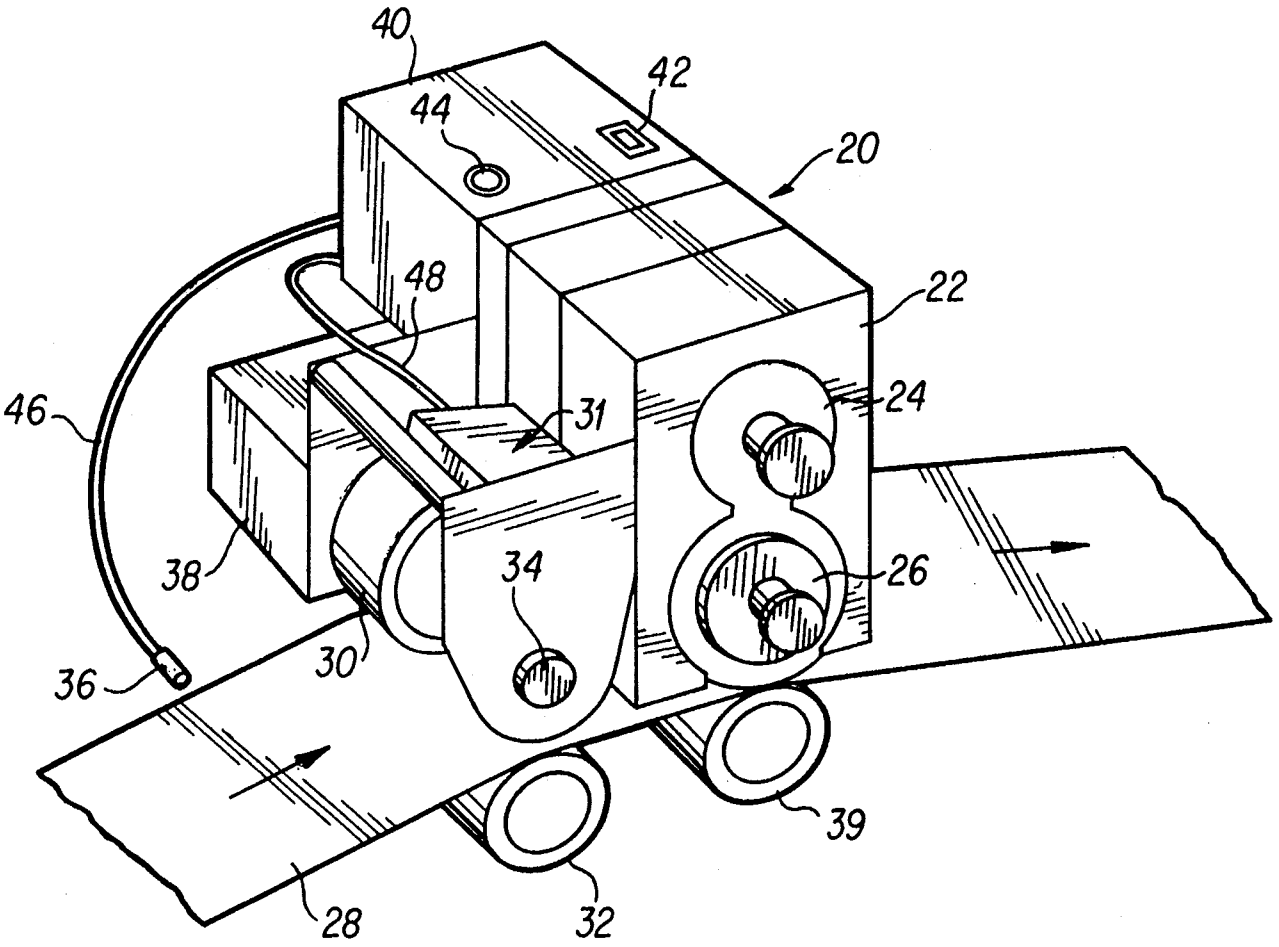
FIG. 1 is a perspective view of a printing apparatus of the type contemplated by the present invention, shown printing on a continuous web or strip of packaging material.

FIG. 1 illustrates an exemplary type of printing or marking apparatus 20 which may be constructed and operated in accordance with the principles of the present invention. The printing apparatus 20 comprises a print head portion 22 which includes a freely rotating inking roll 24 and a printing roll or type holder 26 which is driven by the web 28 being printed. The web 28 may, for example, consist of a strip of wrapping material on which date codes or other indicia are to be printed before the wrapping material is cut and applied to individual products. The web is driven in the direction indicated by the arrows by drive means associated with the wrapping machine or other parent machine (not shown) on which the printing apparatus 20 is installed. In order to allow the web 28 to drive the printing apparatus 20, the web 28 passes between a friction roller 30 and a backup or pressure roller 32. The friction roller 30 is coupled to a solenoid-operated clutch assembly 31 (described in more detail hereinafter) which normally allows the roller 30 to turn freely, but which engages to cause the roller to drive a shaft 34 through 180° or 360° when a signal is received from a sensor 36. The sensor 36 is positioned adjacent to a moving portion of the web conveyor (not shown) or to the web 28 itself, and serves to initiate operation of the printing apparatus 20 at the proper moment to achieve proper print registration. The sensor 36 may comprise a metal-sensing device for detecting the presence of a metallic portion of the conveyor, an optical sensor for sensing a mark on the web 28 itself, or some other suitable type of sensor.

The rear portion of the friction roller shaft 34 is coupled by means of a drive system contained in a rear enclosure 38 to a further shaft (not shown) which turns the printing roll 26. Depending upon whether the solenoid-operated clutch is of the 180° or 360° type, the printing roll 26 will rotate either a half turn or a full turn during each printing cycle. The amount of rotation will depend upon whether the printing roll carries one set of printing elements on its periphery or, as is often the case, two identical sets of printing elements spaced 180° apart. The web 28 passes between the printing roll 26 and a backup or pressure roll 39, and is printed as it passes through the nip defined by these two rolls. When the printing elements carried by the printing roll are not in contact with the web 28 (as would occur between successive printing cycles), the web 28 can pass freely through the nip without rotation of the printing roll 26. Thus, the distance between successive printed indicia on the web 28 is not constrained by the spacing of the printing elements on the printing roll 26.

The printing apparatus 20 also includes an attached electrical control box 40 which contains a terminal block (not shown) for establishing connections between the various electrical components of the apparatus. The control box 40 includes a rocker-type print switch 42 which controls power to the solenoid-operated clutch 31, and an indicator lamp 44 which illuminates when power is applied to the electrical heating elements associated with the inking and printing rolls 24 and 26. A first electrical line 46 connects the control box 40 to the proximity sensor 36, and a second electrical line 48 connects the control box 40 to the solenoid-operated clutch 31. A third electrical line (not shown) connects the control box 40 to a source of electrical power for operating the printing apparatus 20.

Figure 2:
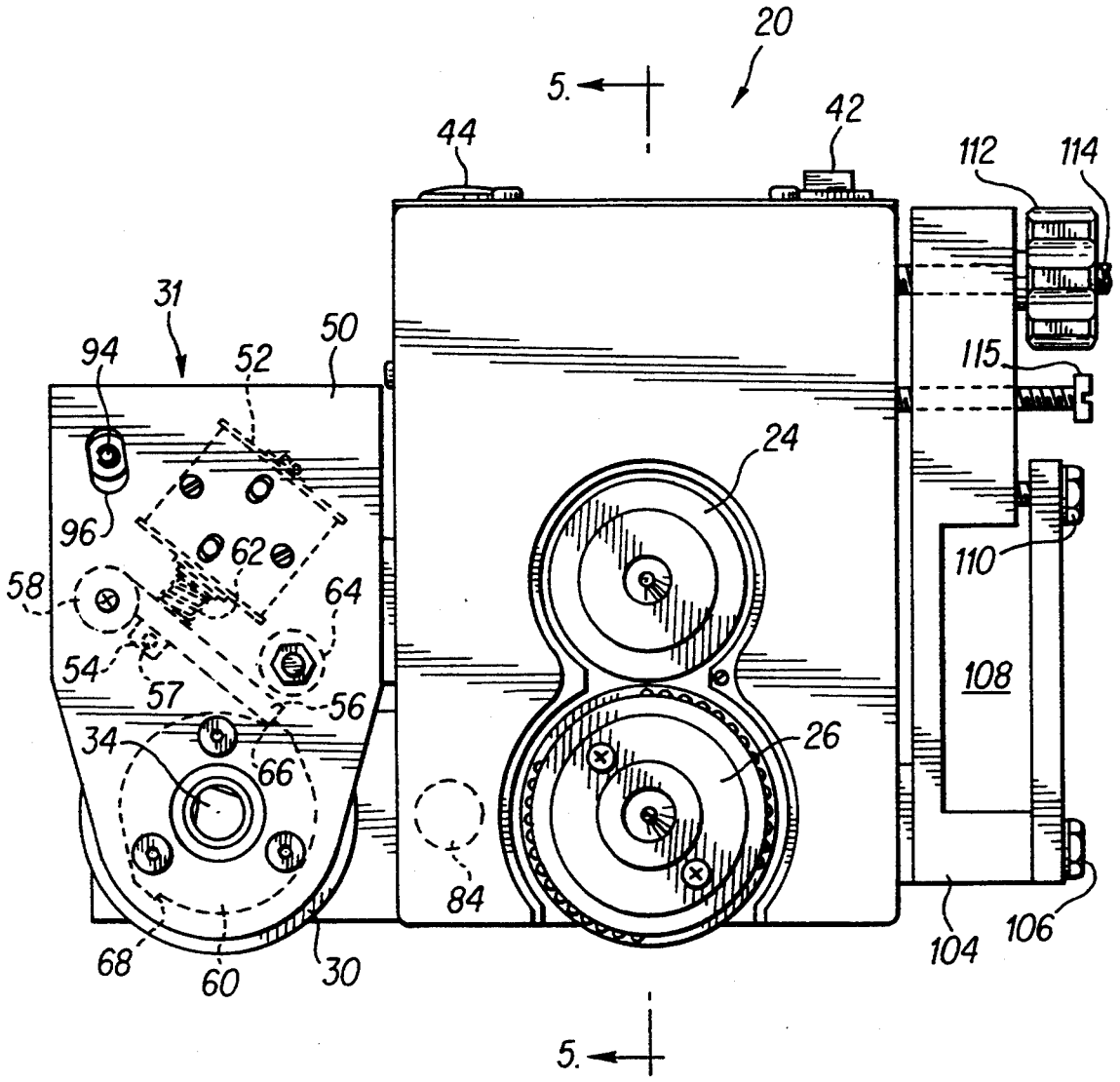
FIG. 2 is a front elevational view of the printing apparatus, with the web and backup rolls of FIG. 1 removed for clarity.
Figure 3:
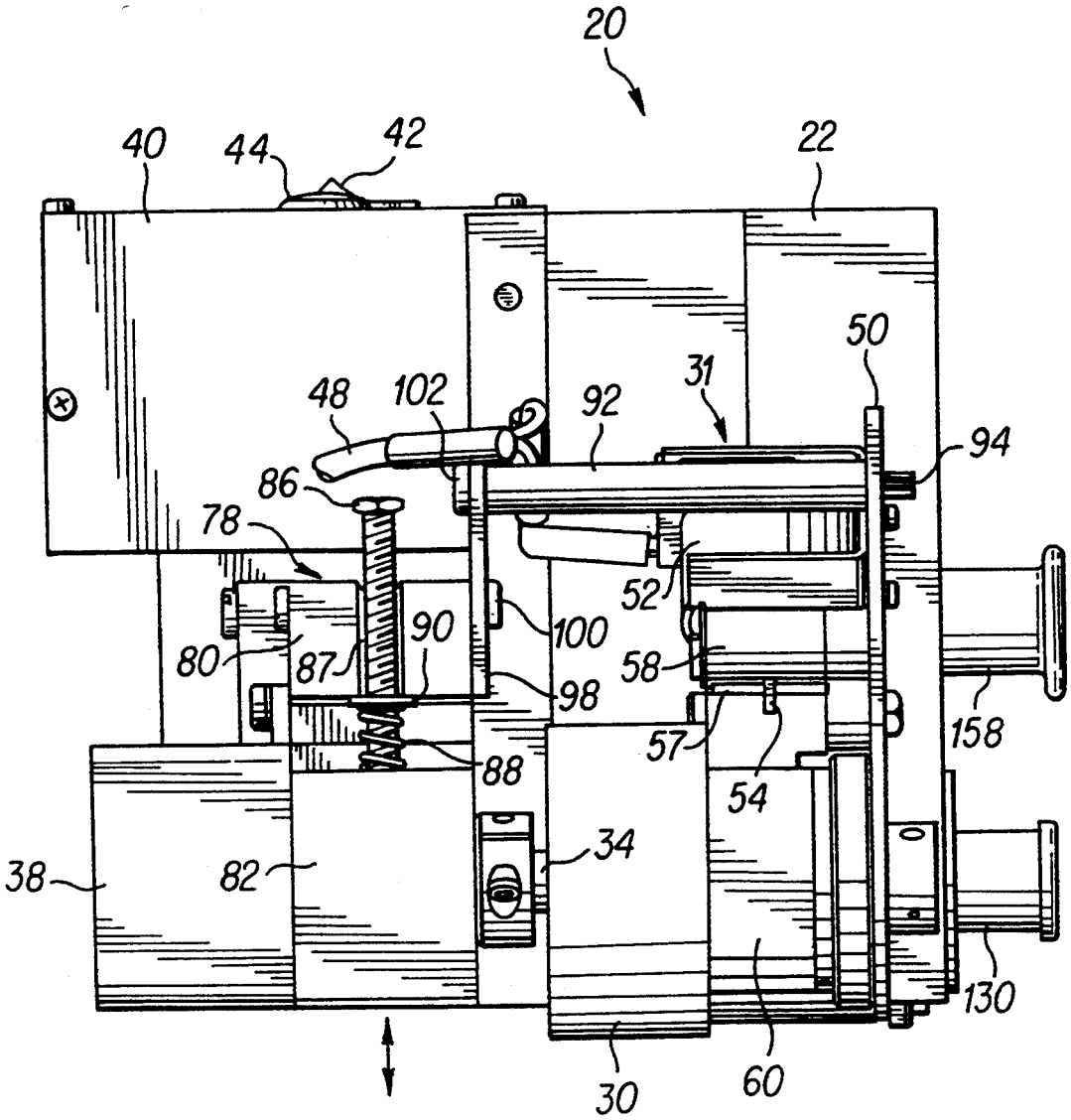
FIG. 3 is a left-side elevational view of the printing apparatus of FIG. 2.
Figure 4:
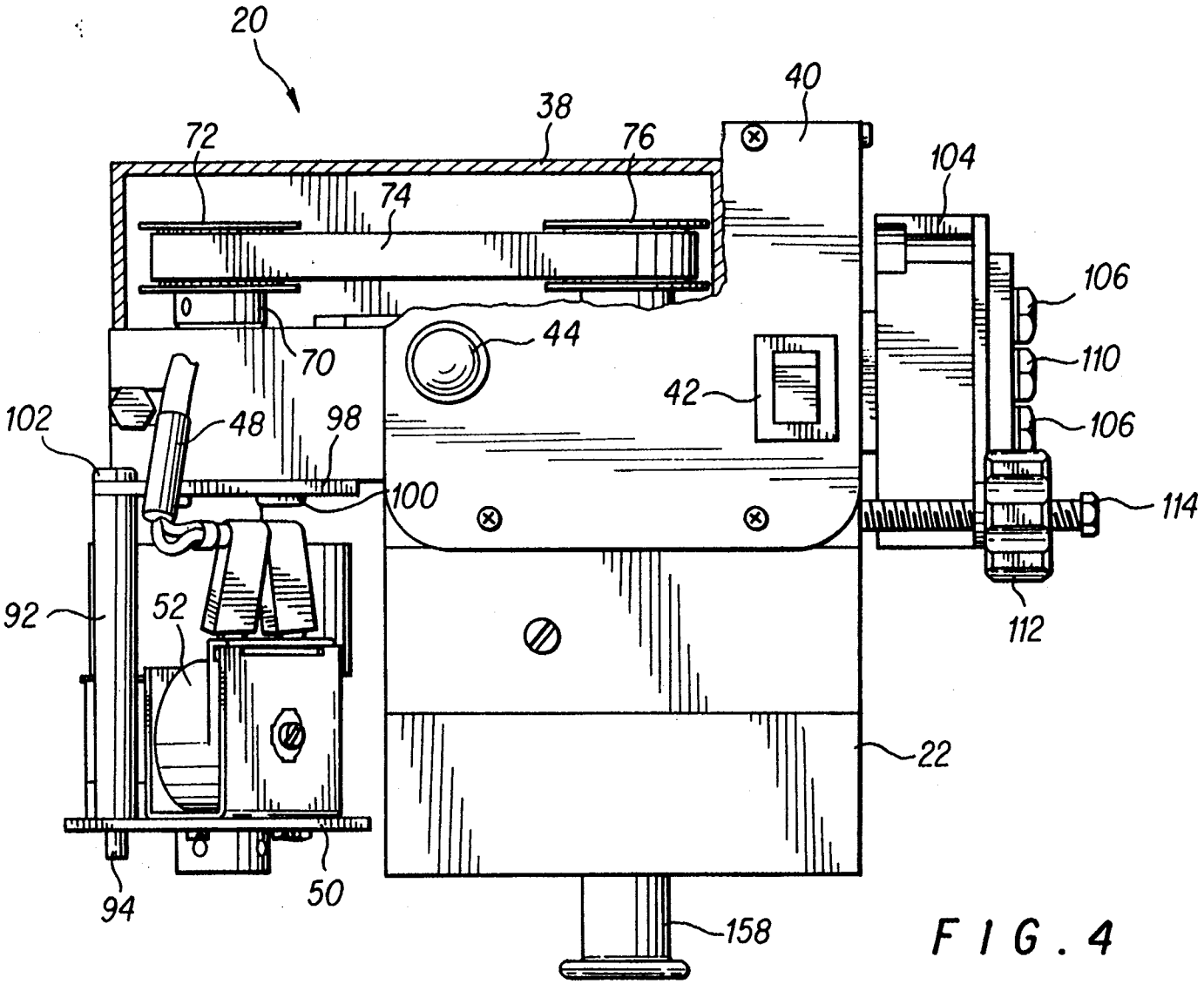
FIG. 4 is a top view of the printing apparatus of FIG. 2, with a portion of the outer enclosure cut away to illustrate the internal drive system.

Additional details of the printing apparatus 20 are illustrated in FIGS. 2–4. The solenoid-operated clutch assembly 31 comprises a mounting plate 50 which carries an electrical solenoid 52. The plunger 54 of the solenoid passes through a slot in a pawl 56 which is carried by a pivoting support 58. A pin 57 passes through a hole in the lower end of the plunger 54. The pawl 56 is normally biased into contact with a collar 60 by means of a coil spring 62 with encircles the solenoid plunger 54 between the solenoid body and the rocker arm. When the solenoid is actuated, the plunger 54 and pin 57 move upwardly and cause the pawl 56 to rotate slightly in a counter-clockwise direction (FIG. 2) about the pivot 58, until the pawl makes contact with an eccentric stop member 64. When this occurs, the end of the pawl 56 is momentarily disengaged from the upper notch 66 of the collar 60. An internal spring-wrap clutch (not shown) coupled to the collar 60 then allows the friction roller 30 to turn the shaft 34 through 180°, until the rocker arm 56 engages the opposite notch 68 of the collar 60. At that point, rotation of the collar 60 stops and the clutch disengages the friction roller 30 from the shaft 34. In cases where a 360° rotation of the shaft 34 is desired during each print cycle, the collar 60 is provided with only one notch on its circumference. The eccentric stop member 64 can be rotated to adjust the upper limit of movement of the pawl 56. The solenoid-operated clutch assembly 31 is a commercially available component and may, for example, comprise a Series SB-4 clutch manufactured by Warner Electric Company of Pittman, N.J.

In FIG. 4, portions of the electrical control box 40 and lower enclosure 38 have been cut away to illustrate the printing roll drive system. The shaft 34 of the friction roll 30 (visible in FIGS. 2 and 3) extends rearwardly into the enclosure 38 and is affixed to the hub 70 of a timing belt pulley 72. A timing belt 74 transmits rotational motion from the timing belt pulley 72 to a second timing belt pulley 76, which drives the printing roll shaft in a manner to be described shortly in connection with FIG. 5.

As shown in FIG. 3, the printing apparatus 20 includes an assembly 78 for applying pressure between the friction roller 30 and the backup roller 32 of FIG. 1. The assembly 78 includes a fixed block 80 and a cantilevered movable block 82, the latter carrying the shaft 34, friction roller 30 and clutch assembly 31. The movable block 82 is arranged to pivot slightly about a pivot axis 84 (visible in FIG. 2) so that the end of the block can move up and down as indicated by the double-headed arrow in FIG. 3. A guide bolt 86 passes loosely through the fixed block 80 and engages a threaded hole in the movable block 82, as shown. A spring 88 is captured between the top of the movable block 82 and a washer 90 at the bottom of the opening 87 of the fixed block 80, and exerts downward pressure on the block 82 that is transferred to the friction roller 30. The spring 88 may be replaced with a different spring exerting a greater or lesser degree of downward force if it is desired to adjust the friction roll pressure.

Vertical motion of the movable block 82 and friction roller 30 during operation of the printing apparatus will cause a similar motion of the entire clutch assembly 31. The clutch assembly is guided in this motion by means of a horizontal support member 92 terminating in a reduced end portion 94 that passes through a slot 96 (visible in FIG. 2) in the clutch mounting plate 50. The support member 92 is affixed by means of a bracket 98 and screws 100 and 102 to the fixed block 80. Vertical movement of the block 82 will, in addition to causing vertical movement of the friction roller 30 and clutch assembly 31, also cause a similar movement of the timing belt pulley 72 shown in FIG. 4. This movement is accommodated by making the dimensions of the rear enclosure 38 sufficiently large to avoid contact with the timing belt pulley 72 throughout its range of movement.

The manner in which the printing apparatus 20 may be attached to a wrapping machine or other parent machine is illustrated in FIGS. 2 and 4. A mounting bracket 104 is shown affixed to the right-hand side of the printing apparatus 20 by means of bolts 106, although the printing apparatus is preferably designed so that the clutch 31 and bracket 104 can be removed and reversed if desired. The mounting bracket 104 defines a rectangular cavity 108 which is dimensioned to receive a standard mounting beam (not shown). An additional bolt 110 is provided to clamp the bracket 104 to the mounting beam. At the top of the bracket 104, a thumbwheel 112 is threaded on a bolt 114 which passes loosely through a slot in the bracket 104 and engages a threaded hole in the side of the printing apparatus 20. By turning the thumbwheel 112 in one direction or the other, the printing apparatus 20 as a whole can be pivoted slightly with respect to the mounting beam in order to adjust the pressure exerted by the printing roll 26 against the backup roll 39 of FIG. 1. A locking screw 115 is received in a threaded hole in the bracket 104 located beneath the thumbscrew 114, and bears against the outside of the printing apparatus 20 in order to maintain the desired printing pressure adjustment.

Figure 5:
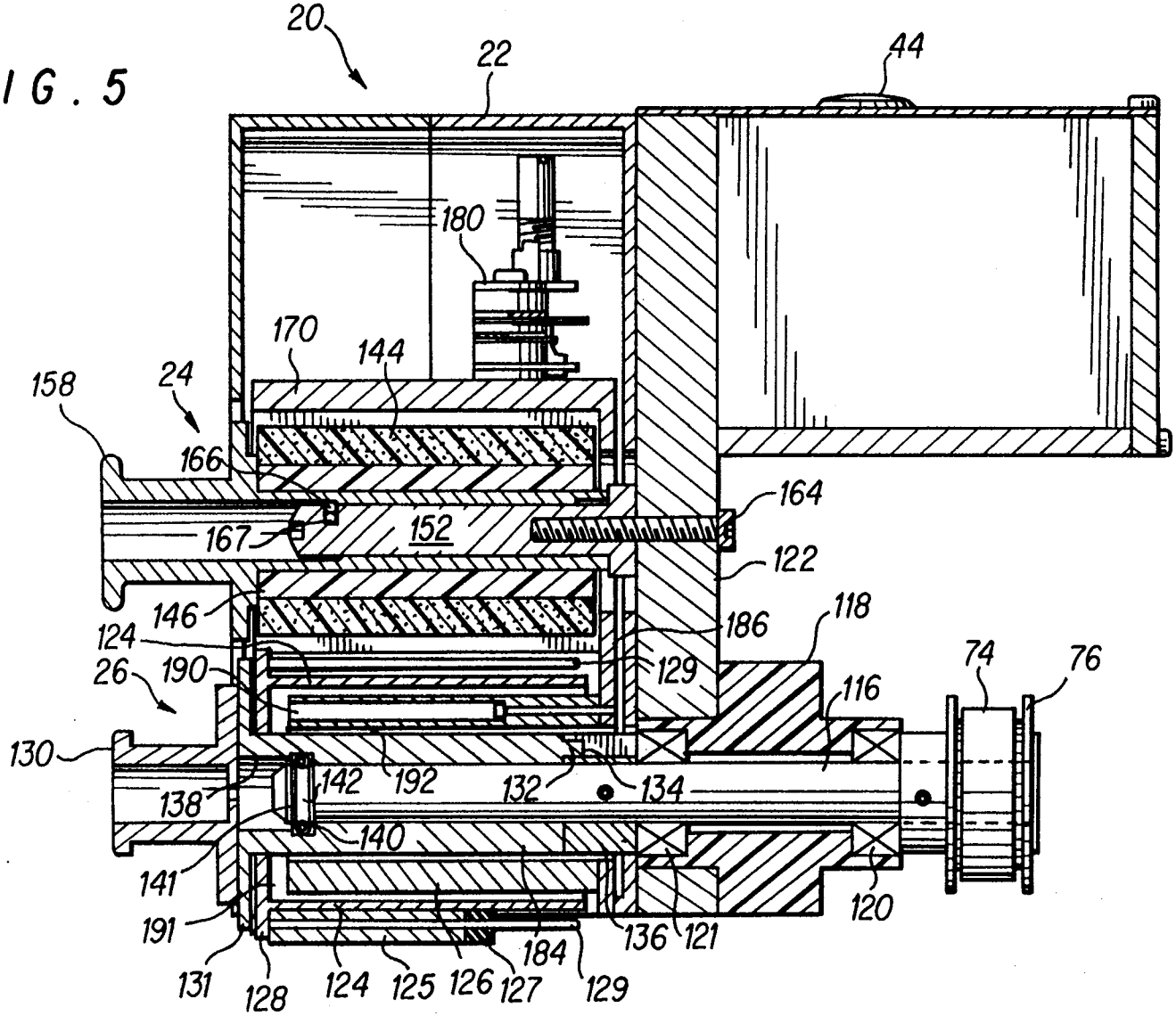
FIG. 5 is a side sectional view of the printing apparatus taken along the line 5—5 in FIG. 2, illustrating the details of the inking and printing rolls.
Figure 6:
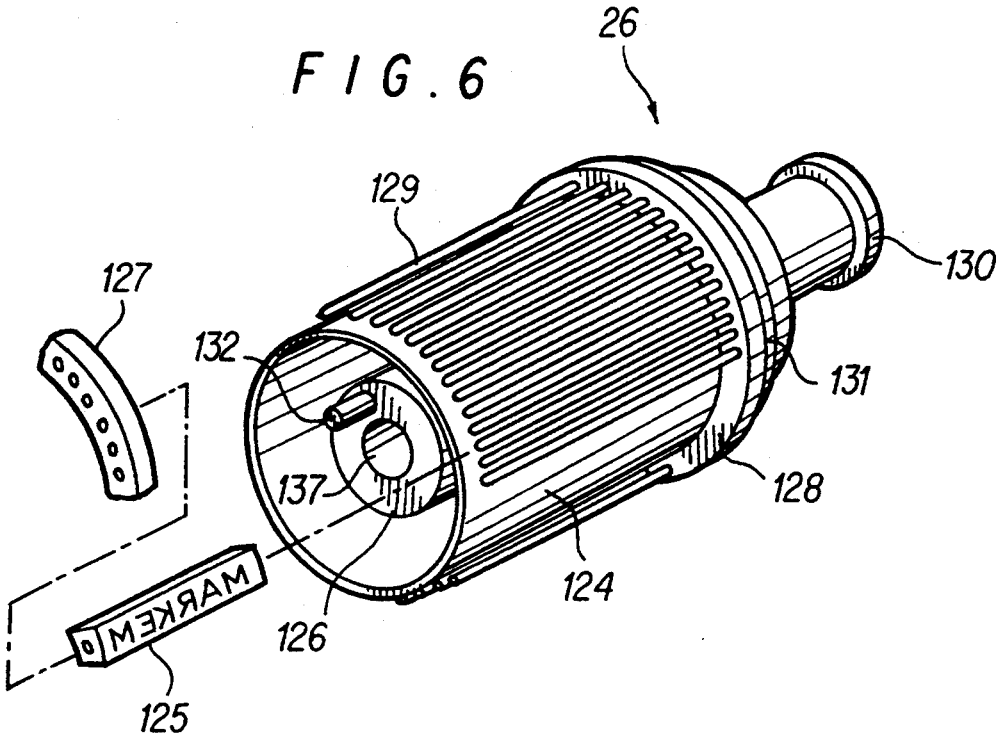
FIG. 6 is an exploded view of the printing roll or type holder assembly used in the printing apparatus of FIG. 2.

Referring now to FIG. 5 (in which the lower enclosure 38 of FIGS. 1, 3 and 4 has been deleted for clarity), the timing belt pulley 76 referred to previously in connection with FIG. 4 is coupled to a shaft 116 which passes through a bearing block 118 and bearings 120 and 121 mounted in the rear frame 122 of the printing apparatus 20 to drive the printing roll 26. The printing roll 26, which is shown in more detail in FIG. 6, is a hollow cylindrical structure consisting of an outer shell 124 for carrying one or more brass, rubber or composite printing elements 125 and rubber type stops 127 on pins 129, and an inner tubular structure 126 which fits over the printing roll shaft 116. (Printing plates made of plastic or other materials can also be used in lieu of the individual printing elements 125, and in that event the pins 129 may be omitted and the plates secured directly to the outside of the printing roll shell 124 by means of an adhesive.) The outer shell 124 and pins 129 extend from a circular plate or disk 128, and the inner tubular structure 126 is carried by a separate disk 131 which is attached to the disk 128 by screws (not shown). The tubular structure 126 passes through a hole in the disk 128 so that it is received coaxially within the outer shell 124. A heat-resistant plastic handle 130 is affixed to the disk 131 in order to allow the printing roll 26 to be inserted and removed from the printing apparatus 20. A pin 132 formed on the inner end of the inner tubular structure 126 is received in a slot 134 (also visible in FIG. 8) formed in a collar 136 that is affixed to the printing roll shaft 116 at a position just in front of the bearing 120 in order to insure proper registration between the printing roll 26 and the shaft 116. The axial bore 137 defined by the inner tubular structure 126 is formed with a counterbore 138 near the closed end defined by the disk 128, and a coil spring 140 is held in the counterbore by means of a grip ring 141. The coil spring 140 engages a groove 142 in the printing roll shaft 116 and serves as a detent for retaining the printing roll 26 on the shaft 116.

Figure 7:
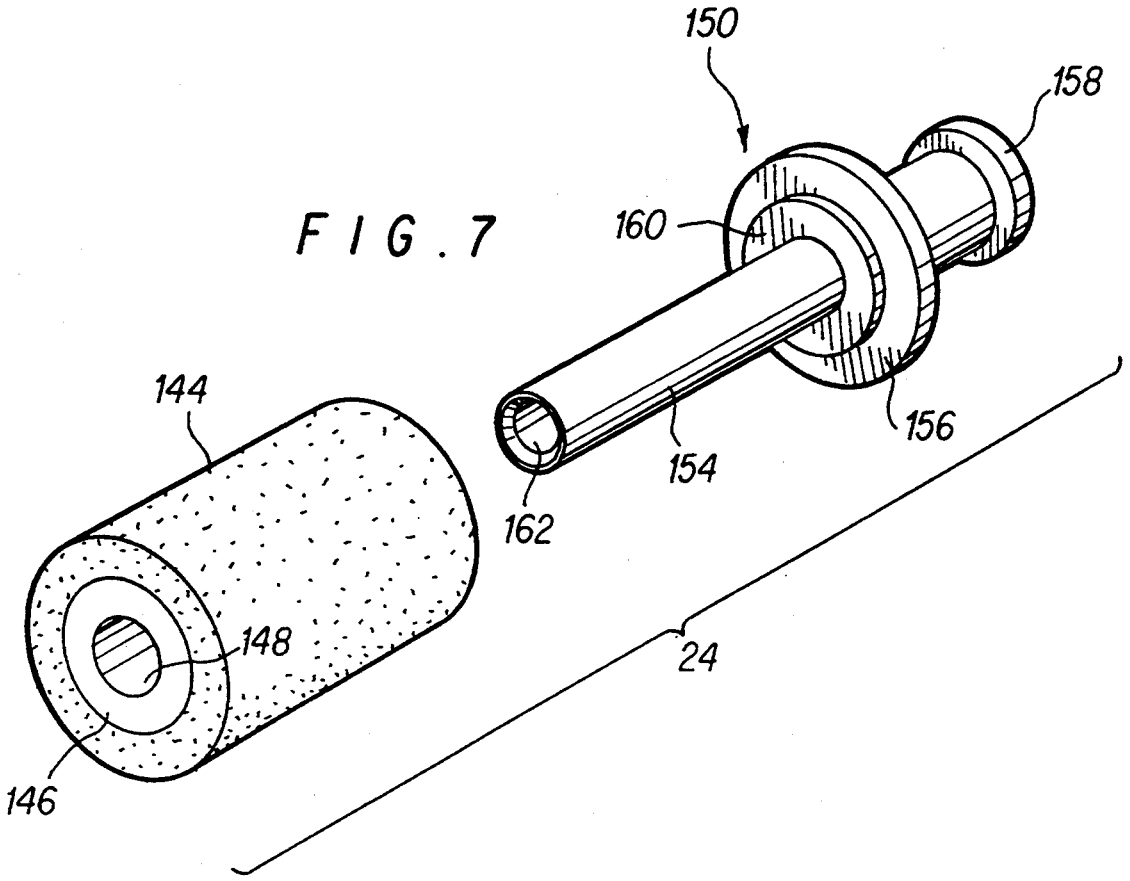
FIG. 7 is an exploded view of the inking roll assembly used in the printing apparatus of FIG. 2.

With continued reference to FIG. 5, the inking roll 24 is rotatably mounted in the printing apparatus 20 at a position above the printing roll 26 so that the printing elements are able to make contact with the periphery of the inking roll 24 as the printing roll 26 is rotated by the shaft 116. The inking roll 24, which is shown in more detail in FIG. 7, consists of a cylindrical body 144 of porous plastic foam which is impregnated with a pigmented thermoplastic ink composition. Inking rolls of this type are sold by Markem Corporation of Keene, N.H., the assignee of the present invention, under the brand names TOUCH-DRY and TOUCH-DRY PLUS. The impregnated ink composition has a hard, solid consistency at normal room temperatures, allowing the inking roll to be handled and stored without ink spillage or mess. At elevated temperatures of about 250° to 300° F., however, the ink composition softens and assumes a fluid state in which it can be transferred to a printing element and ultimately to a surface to be printed. Upon contact with the printed surface, the ink cools and solidifies immediately and the printed image can be handled or subjected to further processing without the danger of smearing. In the manufacture of the inking roll 24, the porous foam body 144 is impregnated with the ink composition only down to a certain depth, leaving an annular non-impregnated region 146 of resilient foam adjoining the axial hole or bore 148. An inking roll hub or arbor 150 carries the porous foam body 144 and allows the inking roll assembly 24 as a whole to be rotatably mounted on the inking roll shaft 152 of FIG. 5. The hub 150 is made of a heat-resistant plastic material and includes an elongated tubular portion 154 which is frictionally received in the axial bore of the porous foam body 144, compressing the non-impregnated foam region 146 somewhat as the hub is inserted. The tubular portion may be provided with longitudinal ribs or grips (not shown) on its external surfaces in order to firmly engage the bore 148 of the foam body 144. A stepped disk or flange 156 prevents heat loss through the end of the porous foam body 144 when the inking roll assembly 24 is installed in the printing apparatus 20, and a handle portion 158 allows the inking roll 24 to be inserted and removed from the printing apparatus 20. The stepped portion 160 of the flange 156 makes contact with the non-impregnated portion of the porous foam body 144, thereby preventing direct contact between the impregnated portion of the foam body 144 and the outer portion of the flange 156. This facilitates removal of the hub 150 from the porous foam body 144 by preventing adhesion between the ink in the impregnated portion of the foam body 144 and the outer portion of the flange 156.

When the inking roll assembly 24 is installed in the printing apparatus 20, as illustrated in FIG. 5, the axial bore 162 in the tubular portion 154 of the hub 150 is received over the inking roll shaft 152. The inking roll shaft 152 is affixed to the rear frame 122 of the printing apparatus by means of a screw 164, and does not rotate. However, the fit between the shaft 152 and hub 150 is sufficiently loose to allow the inking roll 24 to turn on the shaft 152 when it makes contact with the printing elements on the printing roll 26. The inking roll shaft is provided with a ball detent 166 that is carried by a resilient internal ball 167 made of rubber or the like, and this arrangement serves to retain the inking roll assembly 24 on the shaft 152.

Figure 8:
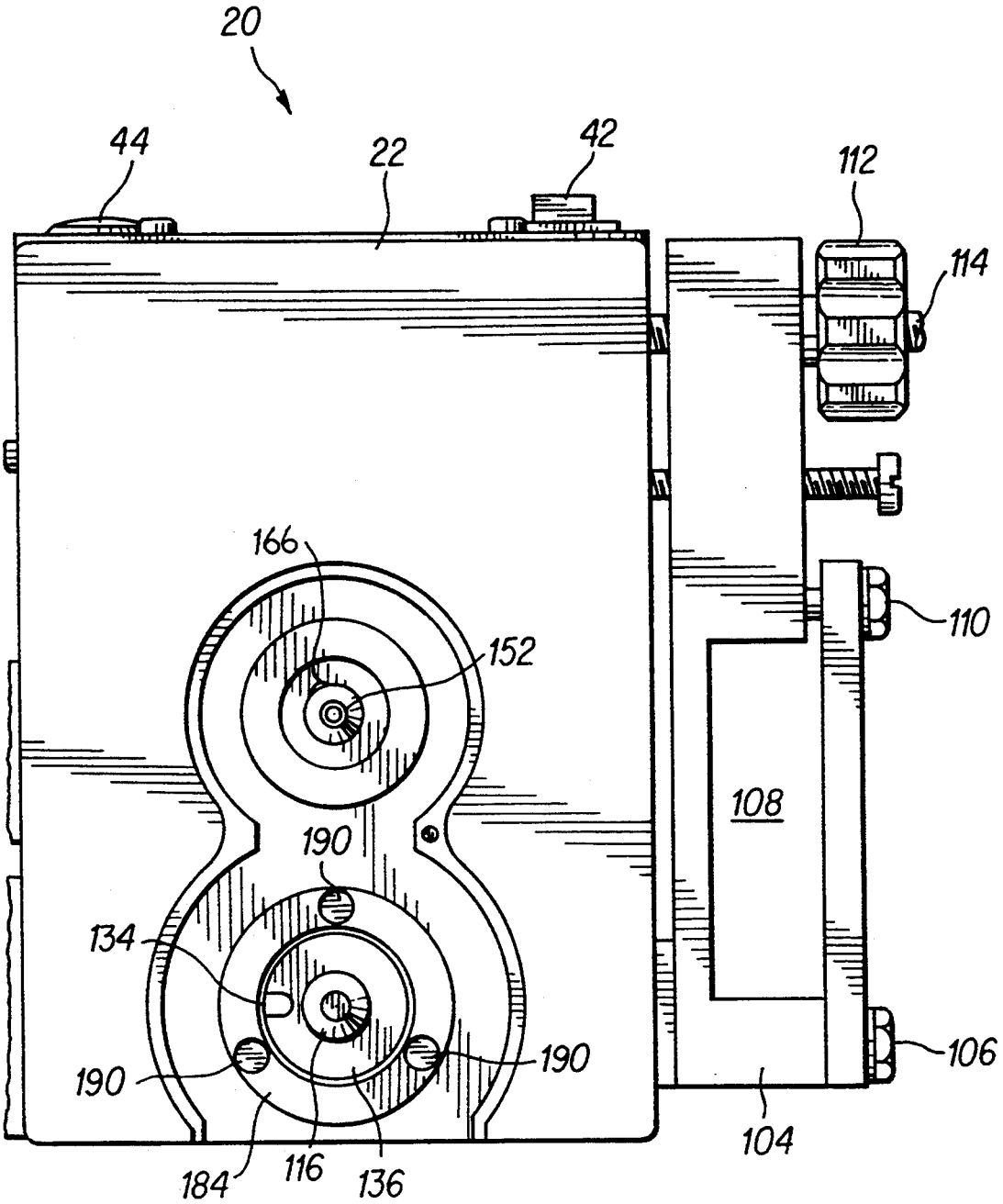
FIG. 8 is a front elevational view similar to FIG. 2, but with the clutch assembly, inking roll and printing roll removed.
Figure 9:
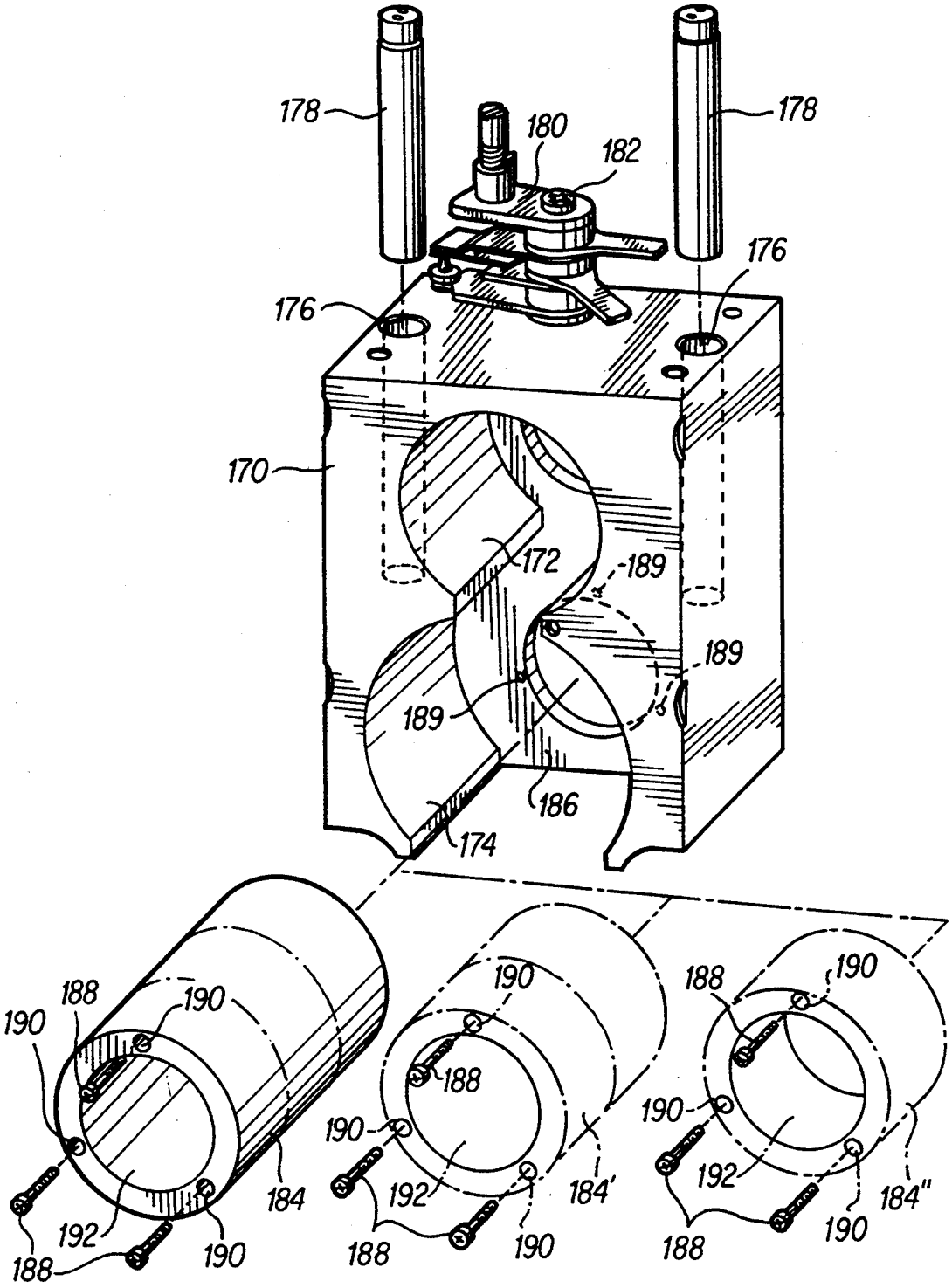
FIG. 9 is an exploded view of the heater block used in the printing apparatus of FIG. 2, illustrating the exchangeable heat pipes, electrical heating elements, and thermostat.

As noted previously, the thermoplastic ink composition which is impregnated in the porous foam body 144 of the inking roll assembly 24 is heated to a temperature in the range of about 250° to 300° F. for printing. The heat is applied to the ink roll 24, in order to initially melt the ink in the porous foam body 144 and to maintain the ink in a melted condition during operation of the printing apparatus 20, and the heat is also applied to the printing elements 125 carried on the printing roll 26 in order to prevent re-solidification of the ink composition as it is conveyed from the inking roll 24 to the surface to be printed. This is accomplished by means of a stationary metal heater block 170, which elevates the temperatures of the inking roll 24, printing roll 26 and printing elements 125 by means of externally applied radiant heat. (Although the term "radiant heat" has been used herein to describe the mechanism by which heat is supplied to the inking roll 24 and printing roll 26, it will be apparent that some degree of convective heating will also occur.) The heater block 170, which is shown in more detail in FIGS. 8 and 9, is preferably made of a solid block of milled or cast aluminum in the shape of an inverted "U", with a rear wall 186 and cylindrical cavities 172 and 174 for receiving the inking and printing rolls 24 and 26, respectively. The interior surfaces of the cavities 172 and 174 conform closely to (but do not touch) the surfaces of the inking and printing rolls in order to promote effective heat transfer. The heater block is formed with two vertical holes 176 on either side of the cavities 172 and 174, and the holes 176 are shaped and dimensioned to receive a pair of cartridge-type electric heating elements 178 which raise the temperature of the heater block 170 by conduction. A bimetallic thermostat 180 is affixed to the top of the heater block 170 by means of a screw 182 in order to sense the temperature of the heater block. The thermostat controls the current to the heating elements 178 in order to maintain a stable temperature, as will be described in more detail hereinafter. It should be apparent that the heater block 170, although preferably made of a solid block of aluminum as described earlier, need only have a thermal conductivity sufficient to transfer heat from the heating elements 178 to the inking and printing rolls 24 and 26, respectively. Clearly, other metallic and non-metallic materials, and other methods of construction, are possible which will meet this objective. It is preferable that the heater block 170 have sufficient thermal mass to maintain relatively stable temperatures at the inking and printing rolls over time, despite variations in printing speed and other factors.

Since the heat radiated from the surface of the cavity 174 may not provide adequate heat to the printing elements of the print roll 26 under all conditions, particularly at higher printing speeds, the heater block 170 is fitted with an additional portion in the form of a heat pipe 184. In the preferred embodiment, the heat pipe 184 comprises a cylindrical sleeve or tube that is made of the same material (preferably aluminum) as the remaining portion of the heater block 170. The heat pipe 184 is affixed to the rear wall 186 of the main portion of the heater block 170 by means of metal screws 188. Longitudinal bores or clearance holes 190 are formed in the heat pipe 184 to allow access to the heads of the screws 188 from the front of the printing apparatus 20, so that the heat pipe may be removed if desired without disassembling the entire printing apparatus. The screws 188 maintain the heat pipe 184 in direct physical and thermal contact with the rear wall 186 of the heater block 170, so that heat generated by the heating elements 178 is conducted into the heat pipe 184. This provides supplemental heating to the interior of the printing roll 26, and this heat is transferred to the printing elements 125 which are in contact with the outer shell 124 of the printing roll. As illustrated in FIG. 5, the cylindrical heat pipe 184 is received in the annulus 191 defined between the inner tubular portion 126 of the printing roll 26 and the outer cylindrical shell 124 which carries the printing elements 125. Since the heat pipe 184 is affixed to the rear wall 186 of the outer portion of the heater block 170 and does not rotate, sufficient clearance is maintained between the inside and outside surfaces of the heat pipe 184 and the adjacent surfaces of the printing roll 26 to allow rotation of the latter. Thus, as will be evident from FIG. 5, the cylindrical opening 192 defined by the heat pipe 184 is of sufficient diameter to receive the inner tubular portion 126 of the printing roll 26 without contact therebetween, and in a similar manner the outer diameter of the heat pipe 184 is sufficiently smaller than the inside diameter of the cylindrical shell 124 of the printing roll 126 to prevent contact between the adjacent surfaces.

In accordance with an important feature of the present invention, it is possible for the user of the printing apparatus 20 to remove the heat pipe 184 when supplemental heat to the printing roll 26 is not required or desired. Such a situation might occur, for example, when the printing apparatus 20 is being used to print on a plastic packaging film having a low softening point, or when the printing apparatus 20 is being used with an ink composition which is intended for application at a lower temperature. In these situations, the heat applied by the outer portion of the heater block 170 may be sufficient to maintain the printing elements 125 on the printing roll 26 at the desired temperature. In order to remove the heat pipe 184, the user first removes the printing roll 26 and preferably also the inking roll 24, in order to leave the printing apparatus 20 in the condition shown in FIG. 8. With the printing roll 26 removed, the heat pipe 184 is exposed and the access holes 190 are accessible to the user. By inserting a screwdriver or other suitable tool through the holes 190, the user can remove the screws 188 which secure the heat pipe 184 to the rear wall 186 of the remaining portion of the heater block 170, thereby removing the heat pipe. The printing roll 26 can then be reinstalled and the printing apparatus 20 can be operated normally. Since the heat pipe 184 is not part of the supporting structure for the printing roll 26, its removal does not affect the operation of the printing apparatus 20 other than by reducing the amount of heat applied to the printing roll 26 and the printing elements 125 carried thereon.

In accordance with another important feature of the present invention, the heat pipe 184 may not only be removed from the printing apparatus 20, but may also be replaced with another heat pipe having different heating characteristics. This is illustrated in FIG. 9 in which three different heat pipes 184, 184' and 184'' are shown. In the illustrated embodiment, the three heat pipes are similar in all respects except axial length, with the heat pipes 184' and 184'' being two-thirds and one-third, respectively, as long as the heat pipe 184. Because of the reduced length, surface area and mass of the replacement heat pipes 184' and 184'', these heat pipes will supply commensurately less heat to the interior of the printing roll 26 than the heat pipe 184. Thus, four different levels of heat can be applied to the interior of the printing roll 26 in the embodiment of FIG. 7, three levels corresponding to the three heat pipes 184, 184' and 184'', and the fourth level corresponding to the absence of a heat pipe.

As a further modification, the heat pipe 184 may be constructed in segments attached to each other in a coaxial end-to-end relationship by screws or other means, as indicated by the phantom lines in FIG. 8. In this embodiment, the size of the heat pipe 184 may be modified simply by adding or removing segments, without the need to exchange the heat pipe with another heat pipe of different size. The segments shown in FIG. 8 each comprise one-third the length of the heat pipe 184, although it is apparent that a greater or lesser number of segments could be employed if desired.

It should be apparent that the length of the heat pipe 184 is only one of a number of different characteristics that can be varied in order to change the amount of heat applied to the interior of the printing roll 26. Other possible characteristics include the diameter, mass or thickness of the heat pipe, the material of which it is made (which will affect its thermal conductivity), the extent of thermal coupling between the heat pipe 184 and the remainder of the heater block 170, the gap or spacing between the heat pipe 184 and the adjacent surfaces of the printing roll 26, and the presence or absence of surface relief or surface coatings on the heat pipe. The illustrated embodiment, in which the heat pipes are all cylindrical and differ only in length, is preferred primarily because of its simplicity and effectiveness in varying the amount of heat delivered to the printing roll 26. The desired simplicity is obtained, in part, due to the fact that the heat pipes 184, 184' and 184'' all have the same diameter and wall thickness, and hence can share the same attachment points 189 on the rear wall 186 of the outer portion of the heater block 170.

Attachment of the heat pipe 184 to the rear wall 186 may be accomplished by means other than the screws 188 and holes 189. Virtually any type of attachment means can be used, although it is preferred that the attachment means be accessible to the user when the printing roll 26 is removed as in the illustrated embodiment. Alternative types of attachment means include bolts, clamps, quick-release and snap fasteners of various kinds, grip rings, adhesives, and other types of threaded and non-threaded fasteners. The attachment means may also be formed on the heat pipe directly, as for example by forming threads or compression fittings on the rear portion of the heat pipe so that the heat pipe can be screwed or inserted directly into a hole in the rear wall 186. If desired, a thermal grease or other heat conducting material may be applied to the adjoining surfaces of the heat pipe and rear wall 186 to promote heat transfer; conversely, a metallic or non-metallic gasket having a reduced thermal conductivity may be interposed between the heat pipe 184 and rear wall 186 if it is desired to limit the amount of heat transferred to the heat pipe.

In order to promote the transfer of radiant heat from the heater block 170 and heat pipe 184 to the adjacent surfaces of the inking roll 24 and printing roll 26, all of these surfaces are preferably provided with a high-emissivity coating having a dark color. Such a coating may, for example, consist of a black anodized layer of aluminum oxide formed on the aluminum surfaces of the heater block 170 and heat pipe 184. Preferably, the anodized layer is formed only on the surfaces which face the inking and printing rolls 24 and 26, so that heat loss from other surfaces of the heater block 170 can be minimized. Thus, with reference to FIG. 9, the anodized coating is preferably provided in the cavities 172 and 174, on the front surface of the back wall 186, and on the interior, exterior and front surfaces of the heat pipe 184. All metallic interior and exterior surfaces of the printing roll 26 (with the exception of the type-holding pins 129) are also preferably provided with a black anodized layer in order to promote the absorption of radiant heat from the heat pipe 184 and remaining portion of the heater block 170. Dark surface coatings of other types may also be used, such as black paint, but anodized coatings are preferred since they are durable, easy to clean, and resistant to heat and abrasion.

Figure 10:
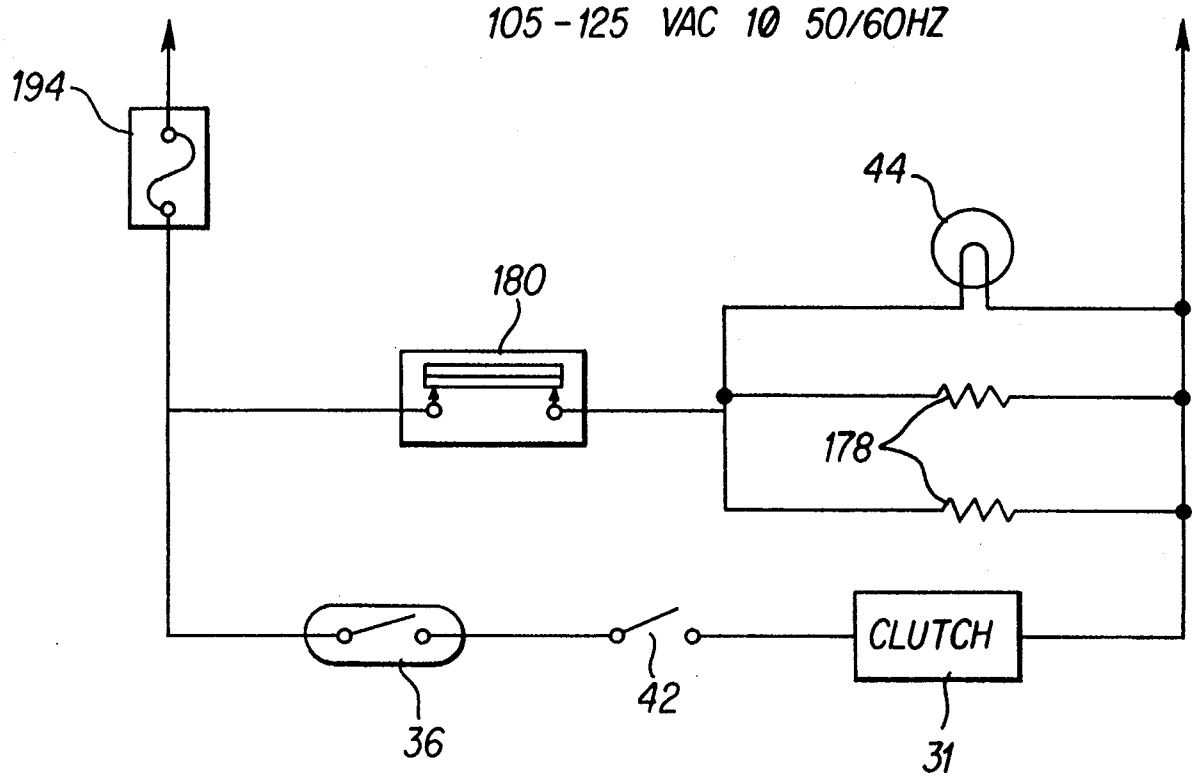
FIG. 10 is a schematic diagram of the temperature control circuit used in the printing apparatus of FIG. 2.

FIG. 10 is a schematic diagram of an electrical circuit which may be used to operate the printing apparatus 20. One side of the incoming A.C. line is connected in parallel via a fuse 194 to the thermostat 180 and to the proximity sensor 36. The opposite side of the thermostat 180 is connected in parallel to the indicator lamp 44 and to the cartridge-type heating elements 178. The opposite terminals of the lamp 44 and heating elements 178 are connected in common to the other side of the incoming A.C. line. Thus, the indicator lamp 44 will illuminate whenever the thermostat is closed, in order to indicate that power is being supplied to the heating elements 178. The proximity sensor 36, print switch 42 and solenoid-operated clutch 31 are connected in series with each other across the incoming A.C. line, and this series connection is in parallel with the circuit containing the thermostat 180 and heating elements 178. Thus, operation of the print switch will control whether or not the printing roll 26 is caused to rotate in response to signals from the proximity sensor 36, but will not affect the current supplied to the heating elements 178. This is useful in situations where it may be desired to temporarily halt the operation of the printing apparatus 20, without requiring a warm-up period when the printing apparatus is again put into operation.

The circuit of FIG. 10 is suitable for operation with a 105–125 volt A.C. source when the heating elements 178, indicator lamp 44 and clutch 31 are rated for that voltage. If a 210–250 A.C. source is substituted, the same 105–125 volt heating elements and indicator lamp can still be used by connecting the heating elements in series with each other and by connecting the indicator lamp in parallel with one of the heating elements. The solenoid-operated clutch 31 is replaced with a new unit rated for the higher voltage, and is then connected in the same manner as shown in FIG. 10.

Simply by way of example, the thermostat 180 of FIG. 10 may comprise a Series HTS unit manufactured by Bimet Corporation of Morris, Ill. The heating elements 178 may comprise 44-watt cartridge heaters manufactured by the Pacific Heater Division of Watlow Corporation, and the proximity sensor 36 may comprise a Model NJ2-12GM50-WS inductive-type sensor manufactured by Pepperl & Fuchs of Germany. The heating elements 178 may be installed in the holes 176 in the heater block using "Watlube" lubricant, manufactured by Watlow Corporation, and this material can also be used as a thermal grease between the heat pipe 184 and the wall 186 of FIG. 9 if desired.

In order to demonstrate the effectiveness of the replaceable heat pipe 184 in controlling the amount of heat applied to the printing roll 26, a printing apparatus 20 of the type illustrated in FIGS. 1–10 was constructed. The external portion of the heater block 170 was made from a solid block of 5083 aluminum alloy approximately 3.5 inches high, 2.8 inches wide and 2.2 inches deep. The ink roll cavity 172 was approximately 1.5 inches in diameter, and the printing roll cavity 174 was approximately 2.1 inches in diameter. Both cavities were approximately 2.0 inches deep. Gaps of approximately 0.06 inch and 0.03 inch were maintained between the surfaces of the inking roll and printing roll cavities 172 and 174 and the surfaces of the inking and printing rolls 24 and 26, respectively. The center-to-center distance between the inking and printing rolls 24 and 26 was approximately 1.7 inches, and the engagement depth of the printing elements into the porous inking roll surface was approximately 0.05 inch. Black anodized layers were provided on the surfaces of the cavities 172 and 174, on the back wall 186, on the heat pipe 184, and on the printing roll 26 as described previously. A single brass type character was installed on the printing roll 26, and a hole was drilled in the type character to receive a thermocouple. With the print roll 26 held stationary, temperature measurements of the type character were taken at various heater block temperature settings using a heat pipe 184 segmented into thirds as indicated in phantom in FIG. 9. The following results were obtained:

TABLE 1

| Block Temperature (Nominal): | 350° F. | 325° F. | 300° F. | 275° F. | 250° F. |
|---|---|---|---|---|---|
| Block Temperature (Variation): | 335–354° F. | 318–331° F. | 297–310° F. | 270–281° F. | 245–256° F. |
| Installed Heat Pipe | | | | | |
| Full Size | 331° F. | 310° F. | 288° F. | 263° F. | 239° F. |
| Two-Thirds | 325° F. | 304° F. | 283° F. | 257° F. | 234° F. |
| One Third | 316° F. | 295° F. | 274° F. | 250° F. | 228° F. |
| None | 273° F. | 252° F. | 233° F. | 211° F. | 192° F. |

Table 1 demonstrates that effective control over the temperature of the printing elements can be obtained mechanically, simply by adding or removing heat pipe sections in order to vary the length of the heat pipe. This allows the printing element temperature to be controlled independently of the inking roll temperature, without introducing additional temperature control circuits or other complex modifications. It has been found that the air gap between the outside surface of the heat pipe 184 and the inside surface of the printing roll shell 124 has a considerable effect of the amount of heat transferred to the printing elements by the heat pipe 184, and this gap is preferably kept to a minimum. It has also been found that, when printing on thermoplastic films with low melting points, the use of a reduced length heat pipe (or the removal of the heat pipe altogether) can be combined with the use of non-metallic printing elements (e.g., rubber type or plastic printing plates) to produce relatively low printing element temperatures.

Although the present invention has been described with reference to a preferred embodiment, it should be understood that the invention is not limited to the details thereof. A number of possible substitutions and modifications have been suggested in the foregoing detailed description, and others will occur to those of ordinary skill in the art. For example, portions of the heater block other than the heat pipe may be made removable if desired, and the need for removing the heat pipe may be avoided by providing a number of exchangeable heater blocks with heat pipes of different sizes permanently attached. It should also be understood that the present invention is applicable to various types of rotary and non-rotary printing and marking devices in which heat is employed, and is not restricted to use with a rotary hot-melt printing apparatus of the specific type shown. These and other substitutions and modifications are intended to fall within the scope of the invention as defined in the appended claims.

What is claimed is:

1. A marking apparatus comprising:

a movable marking member having at least one marking device thereon; and a stationary heating structure having at least one heating element for maintaining said marking device at an elevated temperature;

wherein at least a first portion of said stationary heating structure not in direct physical contact with said movable marking member is removable from said marking apparatus and exchangeable with a replacement portion having a different physical characteristic affecting heating, in order to vary the amount of heat applied to said marking device;

wherein said physical characteristic comprises a dimension of said first portion; and wherein said first portion of said heating structure extends into the interior of said movable marking member, and wherein said dimension comprises the length of such extension.

2. A marking apparatus comprising:

a movable marking member having at least one marking device thereon; and a stationary heating structure having at least one heating element for maintaining said marking device at an elevated temperature;

wherein at least a first portion of said stationary heating structure not in direct physical contact with said movable marking member is removable from said marking apparatus and exchangeable with a replacement portion having a different physical characteristic affecting heating, in order to vary the amount of heat applied to said marking device; and wherein said movable marking member comprises a hollow cylindrical marking roll and said marking device comprises a marking element carried by said marking roll, and further wherein said first portion of said heating structure comprises a cylindrical member which is received inside said marking roll.

3. A marking apparatus as claimed in claim 2, wherein said marking roll is removable from said marking apparatus to expose said cylindrical member, and wherein said cylindrical member is removable from said marking apparatus by means accessible to the user upon removal of said marking roll.

4. A marking apparatus as claimed in claim 2, wherein said physical characteristic comprises the length of said cylindrical member relative to the length of said marking roll.

5. A marking apparatus as claimed in claim 4, wherein said cylindrical member comprises a hollow sleeve, and wherein said marking apparatus further comprises a marking roll shaft extending through said hollow sleeve for carrying said marking roll.

6. A marking apparatus as claimed in claim 2, wherein said stationary heating structure further comprises a second portion which is disposed external to said marking roll in order to apply heat thereto, said second portion being non-removable from said marking apparatus during normal use thereof.

7. A marking apparatus as claimed in claim 6, wherein said marking apparatus further comprises an inking roll for applying ink to said marking element, and wherein said stationary heating structure further comprises a third portion disposed external to said inking roll in order to apply heat thereto.

8. A marking apparatus as claimed in claim 7, wherein said second and third portions of said stationary heating structure together comprise a block of thermally conductive material at least partially surrounding said marking and inking rolls, and wherein said cylindrical member is in thermal contact with said block.

9. A marking apparatus as claimed in claim 7, wherein said ink is of the type which is solid at normal room temperatures and is rendered liquid or flowable at elevated temperatures.

10. A marking apparatus as claimed in claim 9, wherein said inking roll has a porous construction and is impregnated with said ink.

11. A marking apparatus comprising:

a movable marking member having at least one marking device thereon;

a stationary heating structure having at least one heating element for maintaining said marking device at an elevated temperature; and at least first and second supplemental heating structures which are attachable to and removable from said stationary heating structure without direct physical contact with said movable marking member in order to vary the amount of heat applied to said marking device;

wherein said movable marking member comprises a hollow cylindrical marking roll and said marking device comprises a marking element carried by said marking roll, and further wherein said first and second supplemental heating structures each comprise a cylindrical member received inside said marking roll.

12. A marking apparatus as claimed in claim 11, wherein said cylindrical members are attachable to each other in a coaxial end-to-end relationship.

13. A marking apparatus as claimed in claim 12, wherein said marking roll is removable from said marking apparatus to expose said cylindrical members, and wherein said cylindrical members are removable from said marking apparatus by means accessible to the user upon removal of said marking roll.

14. A marking apparatus as claimed in claim 12, wherein said cylindrical members each comprise a hollow sleeve, and wherein said marking apparatus further comprises a marking roll shaft extendible through said hollow sleeves for carrying said marking roll.

15. A marking apparatus as claimed in claim 12, wherein said stationary heating structure further comprises a second portion which is disposed external to said marking roll in order to apply heat thereto, said second portion being non-removable from said marking apparatus during normal use thereof.

16. A marking apparatus as claimed in claim 15, wherein said marking apparatus further comprises an inking roll for applying ink to said marking element, and wherein said stationary heating structure further comprises a third portion disposed external to said inking roll in order to apply heat thereto.

17. A marking apparatus as claimed in claim 16, wherein said second and third portions of said stationary heating structure together comprise a block of thermally conductive material at least partially surrounding said marking and inking rolls, and wherein at least one of said cylindrical members is adapted to be brought into thermal contact with said block.

18. A marking apparatus as claimed in claim 16, wherein said ink is of the type which is solid at normal room temperatures and is rendered liquid or flowable at elevated temperatures.

19. A marking apparatus as claimed in claim 18, wherein said inking roll has a porous construction and is impregnated with said ink.

20. A rotary marking apparatus comprising:

a hollow rotatable marking roll having a least one marking device thereon; and a stationary heating structure having at least one heating element for maintaining said marking device at an elevated temperature, said stationary heating structure including a cylindrical member which is received inside said marking roll without direct physical contact with said marking roll, at least a portion of said cylindrical member being removable from said marking apparatus in order to vary the amount of heat applied to said marking device;

said marking roll being removable from said marking apparatus to expose said cylindrical member, and said cylindrical member or portion thereof being removable from said marking apparatus by means accessible to the user upon removal of said marking roll.

21. A rotary marking apparatus as claimed in claim 20, wherein said cylindrical member comprises a hollow sleeve, and wherein said marking apparatus further comprises a marking roll shaft extending through said hollow sleeve for carrying said marking roll.

22. A rotary marking apparatus as claimed in claim 20, wherein said stationary heating structure comprises a second portion disposed external to said marking roll in order to apply heat thereto, said second portion being non-removable from said marking apparatus during normal use thereof.

23. A rotary marking apparatus as claimed in claim 22, wherein marking device comprises a printing element and said marking apparatus further comprises an inking roll for applying ink to said printing element, and wherein said stationary heating structure further comprises a third portion disposed external to said inking roll in order to apply heat thereto.

24. A rotary marking apparatus as claimed in claim 23, wherein said second and third portions of said stationary heating structure together comprise a block of thermally conductive material at least partially surrounding said marking and inking rolls, and wherein said cylindrical member is in thermal contact with said block.

25. A rotary marking apparatus as claimed in claim 23, wherein said ink is of the type which is solid at normal room temperatures and is rendered liquid or flowable at elevated temperatures.

26. A rotary marking apparatus as claimed in claim 25, wherein said inking roll has a porous construction and is impregnated with said ink.

27. A method for controlling the temperature of a printing element carried by a hollow rotary printing cylinder in a printing apparatus utilizing an ink of the type which is solid at normal room temperatures and is rendered liquid or flowable at elevated temperatures, said printing apparatus including a stationary heating structure having at least one heating element and having a tubular portion extending into the interior of said printing cylinder without direct physical contact with said printing cylinder, said method comprising the step of changing the length of said tubular portion in order to vary the amount of heat applied to the printing element.

28. A marking apparatus comprising:

a movable marking member having at least one marking device thereon; and a stationary heating structure having at least one heating element for maintaining said marking device at an elevated temperature; wherein at least a first portion of said stationary heating structure is removable from said marking apparatus and exchangeable with a replacement portion having a different physical characteristic affecting heating, in order to vary the amount of heat applied to said marking device;

said movable marking member comprises a hollow cylindrical marking roll and said marking device comprises a marking element carried by said marking roll, and said first portion of said heating structure comprises a cylindrical member which is received inside said marking roll;

said stationary heating structure further comprises a second portion which is disposed external to said marking roll in order to apply heat thereto, said second portion being non-removable from said marking apparatus during normal use thereof; and said marking apparatus further comprises an inking roll for applying ink to said marking element, and said stationary heating structure further comprises a third portion disposed external to said inking roll in order to apply heat thereto.

29. A marking apparatus as claimed in claim 28, wherein said physical characteristic comprises a dimension of said first portion.

30. A marking apparatus as claimed in claim 29, wherein said first portion of said heating structure extends into the interior of said movable marking member, and wherein said dimension comprises the length of such extension.

31. A marking apparatus as claimed in claim 28, wherein said marking roll is removable from said marking apparatus to expose said cylindrical member, and wherein said cylindrical member is removable from said marking apparatus by means accessible to the user upon removal of said marking roll.

32. A marking apparatus as claimed in claim 28, wherein said physical characteristic comprises the length of said cylindrical member relative to the length of said marking roll.

33. A marking apparatus as claimed in claim 32, wherein said cylindrical member comprises a hollow sleeve, and wherein said marking apparatus further comprises a marking roll shaft extending through said hollow sleeve for carrying said marking roll.

34. A marking apparatus as claimed in claim 28, wherein said second and third portions of said stationary heating structure together comprise a block of thermally conductive material at least partially surrounding said marking and inking rolls, and wherein said cylindrical member is in thermal contact with said block.

35. A marking apparatus as claimed in claim 28, wherein said ink is of the type which is solid at normal room temperatures and is rendered liquid or flowable at elevated temperatures.

36. A marking apparatus as claimed in claim 35, wherein said inking roll has a porous construction and is impregnated with said ink.

37. A marking apparatus comprising:

a movable marking member having at least one marking device thereon;

a stationary heating structure having at least one heating element for maintaining said marking device at an elevated temperature; and at least first and second supplemental heating structures which are attachable to and removable from said stationary heating structure in order to vary the amount of heat applied to said marking device; wherein said movable marking member comprises a hollow cylindrical marking roll and said marking device comprises a marking element carried by said marking roll, and said first and second supplemental heating structures each comprise a cylindrical member received inside said marking roll;

said cylindrical members are attachable to each other in a coaxial end-to-end relationship;

said stationary heating structure further comprises a second portion which is disposed external to said marking roll in order to apply heat thereto, said second portion being non-removable from said marking apparatus during normal use thereof; and said marking apparatus further comprises an inking roll for applying ink to said marking element, and said stationary heating structure further comprises a third portion disposed external to said inking roll in order to apply heat thereto.

38. A marking apparatus as claimed in claim 37, wherein said marking roll is removable from said marking apparatus to expose said cylindrical members, and wherein said cylindrical members are removable from said marking apparatus by means accessible to the user upon removal of said marking roll.

39. A marking apparatus as claimed in claim 37, wherein said cylindrical members each comprise a hollow sleeve, and wherein said marking apparatus further comprises a marking roll shaft extendible through said hollow sleeves for carrying said marking roll.

40. A marking apparatus as claimed in claim 37, wherein said second and third portions of said stationary heating structure together comprise a block of thermally conductive material at least partially surrounding said marking and inking rolls, and wherein at least one of said cylindrical members is adapted to be brought into thermal contact with said block.

41. A marking apparatus as claimed in claim 37, wherein said ink is of the type which is solid at normal room temperatures and is rendered liquid or flowable at elevated temperatures.

42. A marking apparatus as claimed in claim 41, wherein said inking roll has a porous construction and is impregnated with said ink.

43. A rotary marking apparatus comprising:

a hollow rotatable marking roll having a least one marking device thereon; and a stationary heating structure having at least one heating element for maintaining said marking device at an elevated temperature, said stationary heating structure including a cylindrical member which is received inside said marking roll with at least a portion of said cylindrical member being removable from said marking apparatus in order to vary the amount of heat applied to said marking device; wherein said marking roll is removable from said marking apparatus to expose said cylindrical member, and said cylindrical member or portion thereof is removable from said marking apparatus by means accessible to the user upon removal of said marking roll;

said stationary heating structure comprises a second portion disposed external to said marking roll in order to apply heat thereto, said second portion being non-removable from said marking apparatus during normal use thereof;

said marking device comprises a printing element and said marking apparatus further comprises an inking roll for applying ink to said printing element, and said stationary heating structure further comprises a third portion disposed external to said inking roll in order to apply heat thereto.

44. A rotary marking apparatus as claimed in claim 43, wherein said cylindrical member comprises a hollow sleeve, and wherein said marking apparatus further comprises a marking roll shaft extending through said hollow sleeve for carrying said marking roll.

45. A rotary marking apparatus as claimed in claim 43, wherein said second and third portions of said stationary heating structure together comprise a block of thermally conductive material at least partially surrounding said marking and inking rolls, and wherein said cylindrical member is in thermal contact with said block.

46. A rotary marking apparatus as claimed in claim 43, wherein said ink is of the type which is solid at normal room temperatures and is rendered liquid or flowable at elevated temperatures.

47. A rotary marking apparatus as claimed in claim 46, wherein said inking roll has a porous construction and is impregnated with said ink.

* * * * *